US010735852B2

(12) United States Patent
Matsumura et al.

(10) Patent No.: US 10,735,852 B2
(45) Date of Patent: Aug. 4, 2020

(54) SPEAKER SYSTEM

(71) Applicant: Panasonic Intellectual Property Corporation of America, Torrance, CA (US)

(72) Inventors: Toshiyuki Matsumura, Osaka (JP); Shuji Saiki, Nara (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 16/266,696

(22) Filed: Feb. 4, 2019

(65) Prior Publication Data

US 2019/0246198 A1 Aug. 8, 2019

Related U.S. Application Data

(60) Provisional application No. 62/627,474, filed on Feb. 7, 2018.

(30) Foreign Application Priority Data

Nov. 9, 2018 (JP) ..... 2018-211402

(51) Int. Cl.
*H04R 1/28* (2006.01)

(52) U.S. Cl.
CPC ..... *H04R 1/288* (2013.01); *H04R 1/2819* (2013.01); *H04R 1/2826* (2013.01); *H04R 1/2857* (2013.01); *H04R 2499/15* (2013.01)

(58) Field of Classification Search
CPC .... H04R 1/288; H04R 1/2857; H04R 1/2819; H04R 1/2826; H04R 2499/15; H04R 1/2888; H04R 1/2884; H04R 1/025; H04R 3/12; H04R 2201/02; H04R 2201/028
See application file for complete search history.

(56) References Cited

U.S. PATENT DOCUMENTS 2,224,919 A * 12/1940 Olson ..... H04R 1/2865 181/152
2,646,852 A * 7/1953 Forrester ..... H04R 1/2857 181/156
2,975,852 A * 3/1961 Chave ..... H04R 1/2865 381/342
3,122,215 A * 2/1964 Sutton ..... H04R 1/2857 181/160
3,923,124 A * 12/1975 Hancock ..... H04R 1/2865 181/156

(Continued)

FOREIGN PATENT DOCUMENTS

JP 11-205887 7/1999
WO 2012/073431 6/2012

OTHER PUBLICATIONS

Extended European Search Report dated Jul 4, 2019 in corresponding European Patent Application No. 19154084.8.

*Primary Examiner* — Oyesola C Ojo
(74) *Attorney, Agent, or Firm* — Wenderoth, Lind & Ponack, L.L.P.

(57) ABSTRACT

A speaker system includes a speaker unit that outputs sound, a cabinet having a wall to which the speaker unit is attached, and an acoustic transmission tube that is disposed inside the cabinet and has an open end and a closed end, the acoustic transmission tube having an aperture in a side wall.

7 Claims, 7 Drawing Sheets

(56) References Cited

U.S. PATENT DOCUMENTS

| | | | | | |
|---|---|---|---|---|---|
| 4,628,528 | A * | 12/1986 | Bose | H04R 3/04 | 181/145 |
| 5,197,103 | A * | 3/1993 | Hayakawa | H04R 1/02 | 181/148 |
| 5,373,564 | A * | 12/1994 | Spear | H04R 1/2857 | 181/156 |
| 5,432,860 | A * | 7/1995 | Kasajima | H04R 1/30 | 181/152 |
| 5,821,471 | A * | 10/1998 | McCuller | H04M 1/035 | 181/156 |
| 6,062,338 | A * | 5/2000 | Thompson | H04R 1/2819 | 181/152 |
| 6,411,721 | B1 * | 6/2002 | Spindler | H04R 1/26 | 181/153 |
| 7,450,733 | B2 * | 11/2008 | Suprapmo | H04R 1/2826 | 381/337 |
| 8,031,895 | B2 * | 10/2011 | Schultz | H04R 1/2857 | 381/345 |
| 8,428,291 | B2 * | 4/2013 | Lin | H04R 1/2857 | 181/198 |
| 8,631,558 | B2 * | 1/2014 | Liang | H04R 1/00 | 29/592 |
| 9,414,151 | B2 * | 8/2016 | Kano | H04R 1/2811 | |
| 2009/0136065 | A1 * | 5/2009 | Yano | H04R 9/063 | 381/186 |
| 2012/0300967 | A1 * | 11/2012 | Saiki | H04R 1/288 | 381/349 |
| 2013/0032285 | A1 * | 2/2013 | Mietta | B32B 27/288 | 156/250 |
| 2015/0319523 | A1 * | 11/2015 | Kano | H04R 1/28 | 381/338 |
| 2015/0382090 | A1 * | 12/2015 | Bisset | H04R 1/2857 | 381/386 |
| 2019/0051284 | A1 * | 2/2019 | Magariyachi | H04R 1/34 | |

* cited by examiner

SPEAKER SYSTEM

CROSS REFERENCE TO RELATED APPLICATION

This application claims the benefit of priority of U.S. Provisional Application No. 62/627,474 files on Feb. 7, 2018 and Japanese Patent Application Number 2018-211402 filed on Nov. 9, 2018, the entire contents of which are hereby incorporated by reference.

BACKGROUND

1. Technical Field

The present disclosure relates to a speaker system.

2. Description of the Related Art

In PTL (Patent Literature) 1 (International Application Publication No. WO2012/073431), a speaker system is disclosed that limits the occurrence of standing waves without causing a reduction in the sound pressure level in the low-tone region by disposing an acoustic transmission tube inside a speaker cabinet.

SUMMARY

However, the above PTL was considered to require further improvement.

A speaker system according to an aspect of the present disclosure includes a speaker unit that outputs sound, a cabinet having a wall to which the speaker unit is attached, and an acoustic transmission tube that is disposed inside the cabinet and has an open end and a closed end, the acoustic transmission tube having an aperture in a side wall.

The above embodiment makes it possible to implement further improvement.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DETAILED DESCRIPTION OF THE EMBODIMENTS

Figure 1:
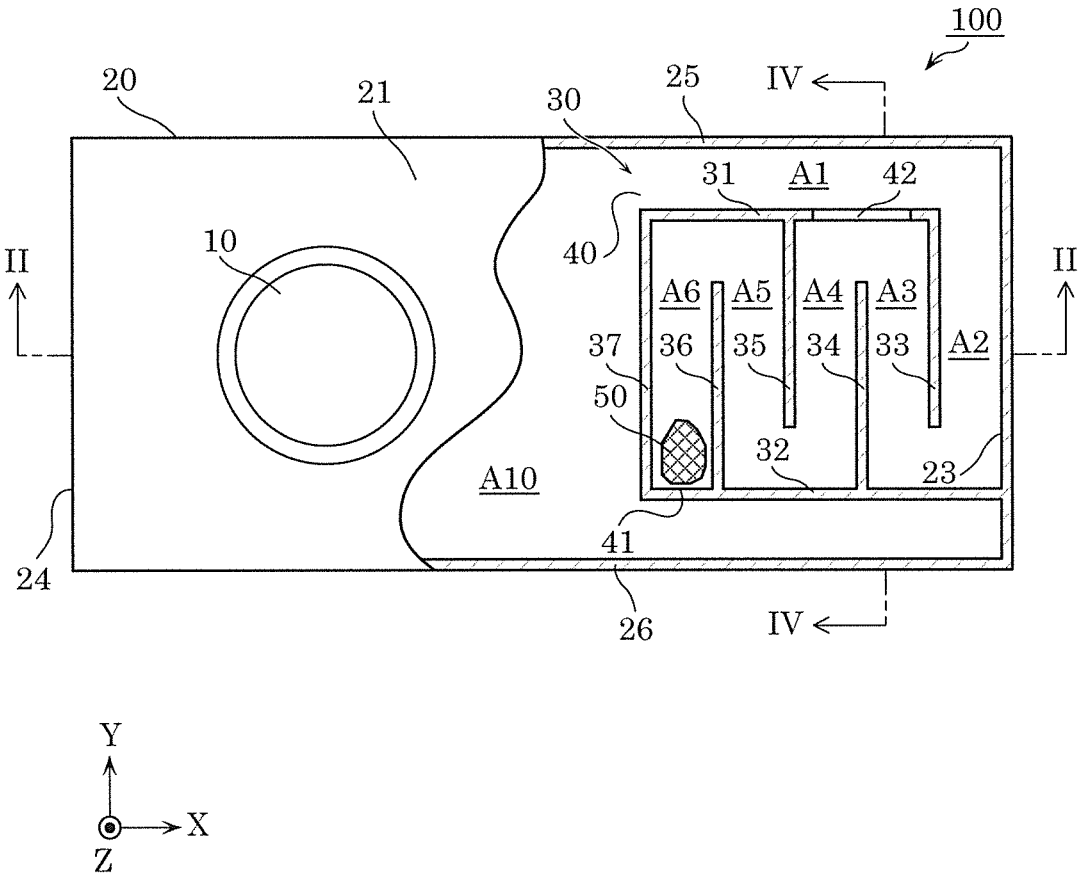
FIG. 1 is a plan view of a speaker system according to Embodiment 1.

Underlying Knowledge Forming Basis of Present Disclosure

The inventors have identified the following problem related to the speaker system mentioned in the section "Background".

Along with the advancements in making televisions in recent years due to liquid crystal displays becoming thinner and organic electroluminescence (EL) becoming more commonplace in television sets, speaker systems in television sets have also become thinner. In thin speaker systems, however, the transmission of sound traveling inside the cabinet is limited by this thickness and the influence of standing waves occurring between the opposing side walls of the cabinet is greater compared to conventional cuboid cabinets. As a result, large crests and troughs occur in the sound pressure frequency response of the speaker system.

The speaker system shown as related art in PTL 1 solves this problem. The conventional speaker system mentioned in PTL 1 includes an acoustic transmission tube inside a speaker cabinet that has an open end and a closed end. The acoustic transmission tube is disposed inside the speaker cabinet so that the side walls of the acoustic transmission tube and the propagation direction of the standing waves occurring inside the speaker cabinet intersect. In the speaker system in PTL 1, the occurrence of standing waves is limited without reducing the sound pressure level in the low-tone region by using a configuration as described above.

Using the above conventional technique, however, resonance in the acoustic transmission tube tends to become bigger, possibly reducing the sound pressure level in the low-tone region and causing a dip in the sound pressure.

Accordingly, the inventors have studied the following measures to improve the dip in the sound pressure in the low-tone region.

A speaker system according to an aspect of the present disclosure includes a speaker unit that outputs sound, a cabinet having a wall to which the speaker unit is attached, and an acoustic transmission tube that is disposed inside the cabinet and has an open end and a closed end, the acoustic transmission tube having an aperture in a side wall.

This makes it possible to reduce the resonance in the acoustic transmission tube thanks to the aperture being disposed in the side wall. Accordingly, for example, the dip in the pressure level in the low-tone region approximate to a lowest resonance frequency $f_0$ in the speaker system can be improved, and a favorable sound pressure frequency response can be obtained.

The aperture may also be a slit along a direction in which the acoustic transmission tube extends.

Accordingly, the resonance in the acoustic transmission tube can effectively be reduced. For example, by adjusting the length of the slit, the resonance in the acoustic transmission tube can easily be adjusted depending on the configuration of the speaker system.

The aperture may also comprise a plurality of holes arranged along a direction in which the acoustic transmission tube extends.

Accordingly, the resonance in the acoustic transmission tube can effectively be reduced while maintaining the strength of the area proximate to the aperture. For example, by adjusting the length of each hole along the direction in which the acoustic transmission tube extends and the number of holes, the resonance in the acoustic transmission tube can easily be adjusted depending on the configuration of the speaker system.

The acoustic transmission tube may also have a first space, a second space that is substantially perpendicular to the direction in which the acoustic transmission extends and communicates with the first space, and a partition plate that is a part of the side wall and separates the first space and the second space except in a portion in which the first space and the second space communicate with each other. The aperture may be disposed in the partition plate.

This makes it possible to effectively reduce the resonance in the acoustic transmission tube.

The acoustic transmission tube may further include a branch that connects to the aperture.

This makes it possible to effectively reduce the resonance in the acoustic transmission tube.

The speaker system may further include a damping cloth that covers the aperture.

The speaker system may further include a sound absorbing material disposed at the closed end of the acoustic transmission tube.

Hereinafter, embodiments in the present disclosure will be described with reference to the drawings.

Embodiment 1

Figure 2:
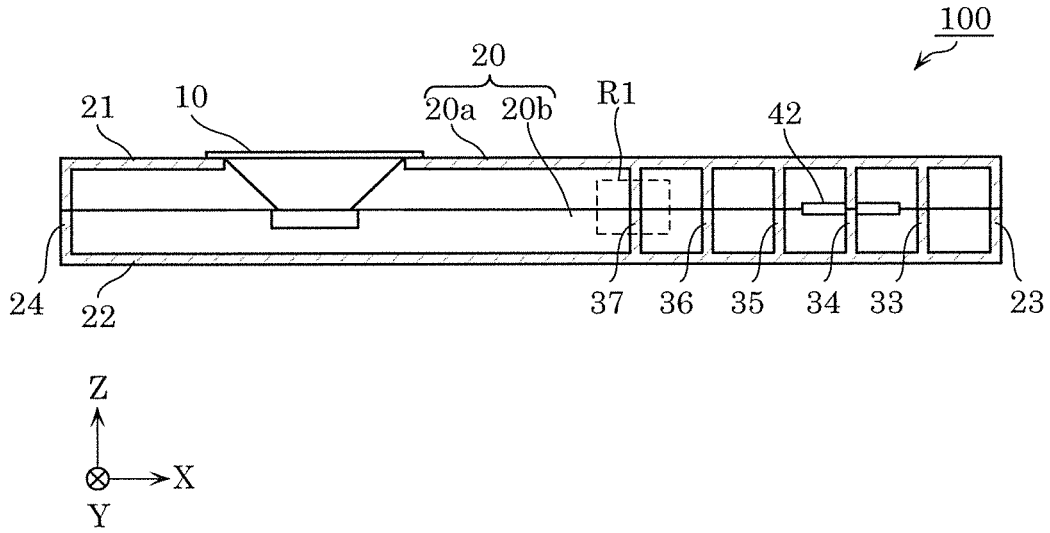
FIG. 2 is a cross-sectional view of the speaker system according to FIG. 1, taken along the line II-II.
Figure 3:
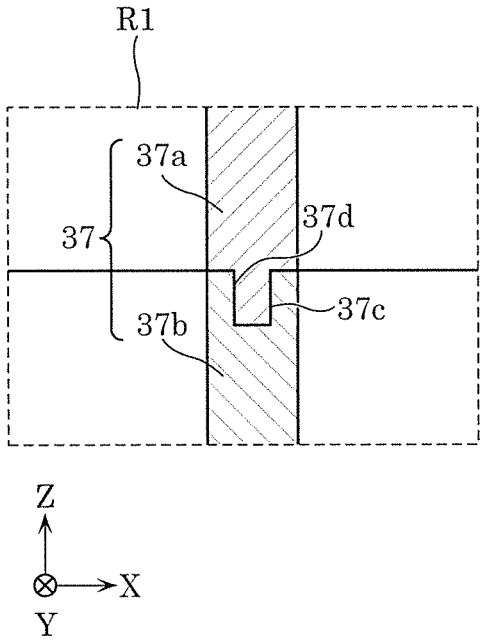
FIG. 3 is an enlarged view of region R1 in FIG. 2.
Figure 4:
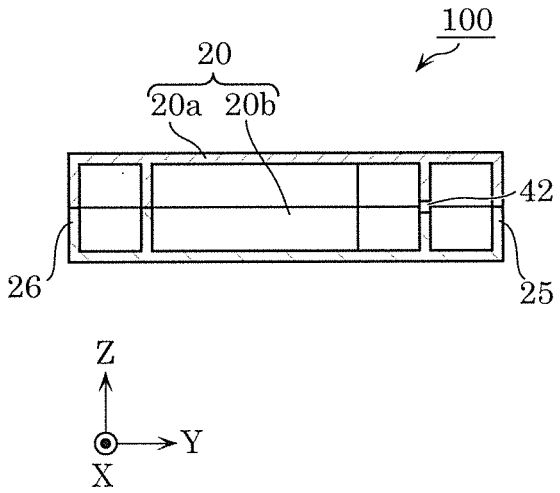
FIG. 4 is a cross-sectional view of the speaker system according to FIG. 1, taken along the line IV-IV.
Figure 5:
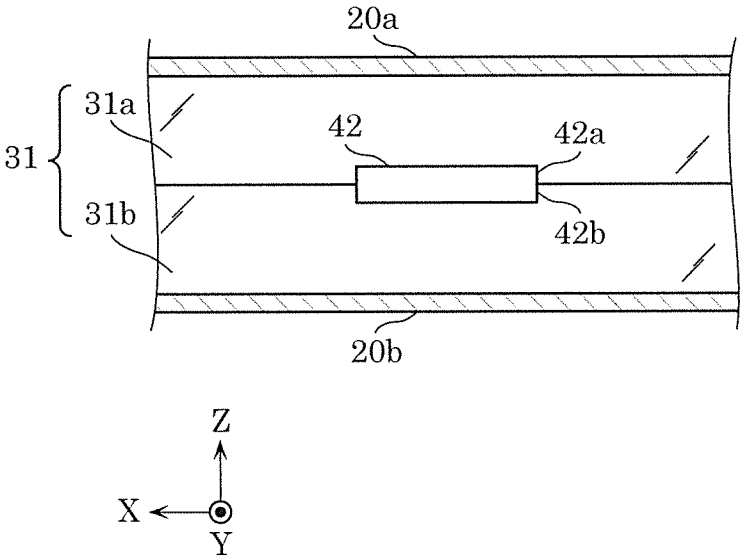
FIG. 5 is an enlarged view of an example of an aperture in a side wall of an acoustic transmission tube.

A speaker system according to Embodiment 1 in the present disclosure is shown in FIGS. 1 to 5. FIG. 1 is a plan view of a speaker system according to Embodiment 1 with a surface thereof partially cut out. FIG. 2 is a cross-sectional view of the speaker system according to FIG. 1, taken along the line II-II. FIG. 3 is an enlarged view of region R1 in FIG. 2. FIG. 4 is a cross-sectional view of the speaker system according to FIG. 1, taken along the line IV-IV. FIG. 5 is an enlarged view of an aperture in a side wall of an acoustic transmission tube. In FIGS. 1 to 5, a front and back of cabinet 20 of speaker system 100 are indicated by a Z-axis, a length of the rectangular cabinet 20 seen from the Z-axis is indicated by an X-axis, and a width of cabinet 20 is indicated by a Y-axis.

Speaker system 100 includes speaker unit 10 and the thin cuboid cabinet 20.

Speaker unit 10 is attached to front panel 21 of cabinet 20. Speaker unit 10 includes a diaphragm, magnetic circuit, and voice coil that are not illustrated.

Cabinet 20 includes front panel 21, rear panel 22, side panels 23 and 24 disposed at both sides of the X-axis of cabinet 20, side panels 25 and 26 disposed at both sides of the Y-axis of cabinet 20, and partition plates 31 to 37 disposed inside cabinet 20. Cabinet 20 includes first cabinet portion 20*a* that constitutes a front portion thereof, and second cabinet portion 20*b* that constitutes a rear portion thereof. Cabinet 20 is a speaker cabinet.

Cabinet 20 has a configuration in which side panels 23 to 26 and partition plates 31 to 37 are divided front to back. In other words, side panels 23 to 26 and partition plates 31 to 37 are formed by joining front portions of side panels 23 to 26 and partition plates 31 to 37 included in first cabinet portion 20*a* and rear portions of side panels 23 to 26 and partition plates 31 to 37 included in second cabinet portion 20*b*.

As illustrated in FIG. 3, partition plate 37 is, for example, formed by joining front partition portion 37*a* included in first cabinet portion 20*a* and rear partition portion 37*b* included in second cabinet portion 20*b*. Front partition portion 37*a* includes protrusion 37*c* extending from a front end surface of front partition portion 37*a* and elongated along a length of the end surface. Rear partition portion 37*b* includes a groove-shaped notch 37*d* disposed on a rear end surface of rear partition portion 37*b*, and connects with protrusion 37*c* disposed on front partition portion 37*a*. The other partition plates 31 to 36 also include a protrusion and notch that connect with each other, similar to partition plate 37. Side panels 23 to 26 may also include a protrusion and notch that connect with each other, similar to partition plate 37. Note that the protrusion and notch are not limited to the above elongated and grooved shapes provided they can connect with each other. For example, the protrusion may be cylindrical and the notch may also be a cylindrical hole. This makes it possible to improve a joint strength of first cabinet portion 20*a* and second cabinet portion 20*b* since they are joined by connecting the protrusions and notches to each other.

Partition plates 31 to 37 are coupled to front panel 21 and rear panel 22 of cabinet 20. Partition plate 31 is disposed at a predetermined distance from side panel 25 and side panel 23, and is substantially parallel with side panel 25. Partition plate 32 is disposed at a predetermined distance from side panel 26, and is substantially parallel with side panel 26. Partition plate 32 is coupled to an end of side panel 23. In this manner, partition plates 31 and 32 are disposed parallel with side panels 25 and 26, and are rectangular with their lengths along the X-axis when seen along the Y-axis. Accordingly, the strength (stiffness) along the X-axis of cabinet 20, which includes a long inner space along the X-axis, can be improved, and a favorable sound pressure frequency response can be obtained.

Partition plates 33 to 37 are disposed parallel with side panel 23, and are each arranged along the X-axis of cabinet 20 at the predetermined distance from side panel 23 with side panel 23 as reference. For partition plates 33 and 35, one end is coupled to partition plate 31 and another end is disposed at the predetermined distance from partition plate 32. For partition plates 34 and 36, one end is disposed at the predetermined distance from partition plate 31 and another end is coupled to partition plate 32. For partition plate 37, one end is coupled to partition plate 31 and another end is coupled to partition plate 32. Note that in the above description, components are coupled to each other without a gap. In this manner, partition plates 33 to 37 are disposed parallel with side panels 23, and are rectangular with their lengths along the Y-axis when seen along the X-axis. Moreover, partition plates 33 to 37 are disposed between partition plates 31 and 32 along the Y-axis. Accordingly, the strength (stiffness) along the Y-axis of cabinet 20 can be improved, and a favorable sound pressure frequency response can be obtained.

In this manner, acoustic transmission tube 30 is formed inside cabinet 20 due to partition plates 31 to 37 dividing an inside of cabinet 20. In other words, acoustic transmission tube 30 includes, in a space between front panel 21 and rear panel 22, (i) a first acoustic transmission tube space A1 demarcated by side panel 25 and partition plate 31, (ii) a second acoustic transmission tube space A2 demarcated by side panel 23 and partition plates 32 and 33, (iii) a third acoustic transmission tube space A3 demarcated by partition plates 31 to 34, (iv) a fourth acoustic transmission tube space A4 demarcated by partition plates 31, 32, 34, and 35, (v) a fifth acoustic transmission tube space A5 demarcated by partition plates 31, 32, 35, and 36, and (vi) a sixth acoustic transmission tube space A6 demarcated by partition plates 31, 32, 36, and 37. Each of front panel 21, rear panel 22, and partition plates 31 to 37, which form acoustic transmission tube 30, is an example of a side wall of acoustic transmission tube 30.

Space A1 is elongated along the X-axis. Space A1 is an example of a first space. Spaces A2 to A6 are elongated along the Y-axis. Each of spaces A2 to A6 is an example of a second space.

The first space and second space are divided by partition plate 31. In other words, partition plate 31 is a part of the side wall of acoustic transmission tube 30, and is disposed as to divide the inside of cabinet 20 into the first space and the second space, except in a portion in which the first space and the second space communicate with each other. As illustrated in FIG. 5, partition plate 31 has aperture 42. Aperture 42 is, for example, a slit along the direction in which acoustic transmission tube 30 extends. Since aperture 42 is disposed in partition plate 31, aperture 42 is a slit along the X-axis in the present embodiment. Aperture 42 is disposed in partition plate 31 and communicates with the first space and the second space. As mentioned above, partition plate 31 includes front partition portion 31*a* disposed in first cabinet portion 20*a*, and rear partition portion 31*b* disposed in second cabinet portion 20*b*. Aperture 42 has front cut-out portion 42*a* in front partition portion 31*a*, and rear cut-out portion 42*b* in rear partition portion 31*b*. Front cut-out portion 42*a* and rear cut-out portion 42*b* face each other in the orientation of the Z-axis, and form aperture 42 by being joined together. Note that aperture 42 is formed by front partition portion 31*a* and rear partition portion 31*b* each having a cut-out, but is not limited thereto, and only one of front partition portion 31*a* and rear partition portion 31*b* may also have the cut-out or a slit-shaped through-hole.

One width of space A1 communicates with a space in which speaker unit 10 is disposed, and another width communicates with space A2. One width of space A2 communicates with space A1 and another width communicates with space A3. One width of space A3 communicates with space A2 and another width communicates with space A4. One width of space A4 communicates with space A3 and another width communicates with space A5. One width of space A5 communicates with space A4 and another width communicates with space A6. One width of space A6 communicates with space A5 and another width of space A6 is closed.

Acoustic transmission tube 30 has one tubular space in which spaces A1 to A6 are serially connected, and the tubular space has an open end (aperture 40) and a closed end (end edge 41). Moreover, spaces A2 to A6 meander by communicating with one another at either partition plate 31 or partition plate 34.

An operation of speaker system 100 with the above configuration will be described with reference to the sound pressure frequency response in FIG. 4. When electric power is applied to speaker unit 10 attached to front panel 21 of cabinet 20, the diaphragm of speaker unit 10 vibrates and emits sound. The sound emitted through the inner space of cabinet 20 is also transmitted inside acoustic transmission tube 30 formed by a part of cabinet 20 and partition plates 31 to 37. End edge 41 of acoustic transmission tube 30 is closed, and the sound inside cabinet 20 is not emitted to an outside from acoustic transmission tube 30.

As described above, the present embodiment differs greatly from conventional speakers systems in that acoustic transmission tube 30 having aperture 42 in the side wall is disposed inside cabinet 20. Accordingly, an operation of the present embodiment will be described with comparison to a conventional thin and closed-type speaker system.

Internal dimensions of cabinet 20 according to Embodiment 1 in FIGS. 1 to 3 are 410 mm in length, 210 mm in width, and 10 mm in thickness. Moreover, the dynamic speaker unit 10 is 8 cm in diameter and 12 mm in thickness. Furthermore, partition plates 31 to 37 are 180 mm in length, and the distance in between each plate is 30 mm.

Cabinet 20 according to Embodiment 1 is a cuboid thinner than it is long and high. For example, acoustic transmission tube 30 may be disposed in cabinet 20 for which a ratio of the thickness to the length is at least 10 and may be at least 20.

Acoustic transmission tube 30 according to Embodiment 1 is disposed to reduce an inner length of cabinet 20 (length of cabinet 20 in this example) in appearance. In other words, acoustic transmission tube 30 is disposed so that the side wall of acoustic transmission tube 30 (partition plate 37) and the propagation direction (lengthwise) of the standing waves occurring inside cabinet 20 intersect (orthogonally). In other words, partition plate 37 intersects with an alignment orientation of speaker unit 10 in cabinet 20 and acoustic transmission tube 30 (longitude of cabinet 20).

As a result, the inside of cabinet 20 is separated acoustically into the space that contains acoustic transmission tube 30 and rear volume A10 of speaker unit 10. Note that rear volume A10 of speaker unit 10 indicates a volume of the inner space of cabinet 20 excluding the space surrounded by partition plates 31 to 37 (i.e., acoustic transmission tube 30).

With this, the sound from speaker unit 10 is transmitted to acoustic transmission tube 30 after being emitted to rear volume A10. Since the distance between partition plates 31 to 37 is narrow at 30 mm, the long and narrow acoustic transmission tube 30 is considered to be attached to rear volume A10 from an acoustic point of view. To be specific, acoustic transmission tube 30 in Embodiment 1, as an acoustic passage way that is folded due to partition plates 31 to 37, is approximately 400 mm in length, and a cross section of acoustic transmission tube 30 is rectangular, but when the cross section is regarded as an equivalent circle, the diameter of the cross section is 20 mm.

With this, rear volume A10 and acoustic transmission tube 30 are both present between side panels 23 and 24 facing each other along the width of cabinet 20. This makes it possible to effectively limit the occurrence of standing waves.

Figure 6:
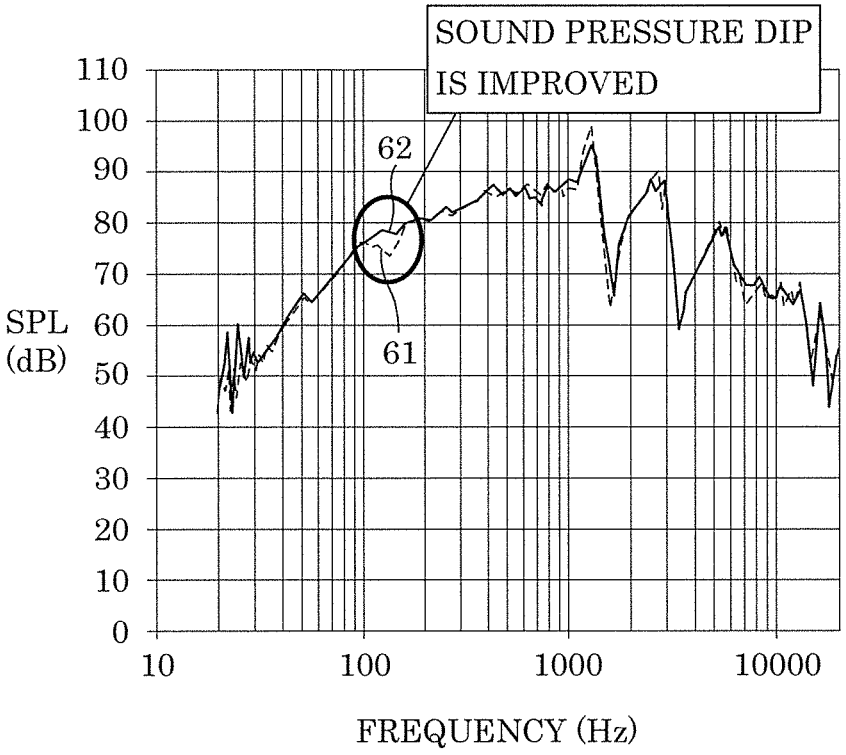
FIG. 6 is a diagram showing a sound pressure frequency response of the speaker system according to Embodiment 1.

FIG. 6 is a diagram showing the sound pressure frequency response of the speaker system according to Embodiment 1.

In speaker system 100 shown in FIGS. 1 to 3, a sound pressure frequency response of the conventional closed-type speaker system without aperture 42 in acoustic transmission tube 30 is indicated by pattern 61, and the sound pressure frequency response of the speaker system according to the present embodiment is indicated by pattern 62 in FIG. 6. In pattern 61, a sound pressure dip occurs in the 100 Hz to 200 Hz range due to the resonance in acoustic transmission tube 30 in cabinet 20 being too great. In pattern 62, however, the sound pressure dip in pattern 61 has been improved, and it is clear that the sound pressure frequency response has a smoother shape.

As described above, speaker system 100 according to the present embodiment makes it possible to reduce the resonance in acoustic transmission tube 30 due to having an aperture in the side wall. Accordingly, the dip in the pressure level in the low-tone region approximate to the lowest resonance frequency $f_0$ in speaker system 100 can be improved, and a favorable sound pressure frequency response can be obtained.

In speaker system 100 according to the present embodiment, aperture 42 is a slit along the direction in which acoustic transmission tube 30 extends. Accordingly, the resonance in acoustic transmission tube 30 can effectively be reduced. For example, by adjusting the length of the slit, the resonance in acoustic transmission tube 30 can also be easily adjusted depending on the configuration of speaker system 100.

Speaker system 100 according to the present embodiment makes it possible to realize a speaker system with high sound quality that has exceedingly few disruptions in the sound pressure frequency response caused by to the occurrence of standing waves inside cabinet 20. Moreover, since aperture 40 in acoustic transmission tube 30 has no sound absorbing material, the sound inside cabinet 20 is not dampened by the sound absorbing material, and there is no reduction in the sound pressure level particularly in the low-tone region.

Note that sound absorbing material 50 may further be disposed at end edge 41 of acoustic transmission tube 30 as illustrated in FIG. 1. This makes it possible to more effectively limit the resonance and obtain a smoother sound pressure frequency response when the resonance in acoustic transmission tube 30 is too great. In this case, sound absorbing material 50 is present inside cabinet 20, but since sound absorbing material 50 is disposed at the closed end edge 41 of acoustic transmission tube 30, not much sound passes through, and a reduction in the sound pressure level in the low-tone region can be limited due to the sound-absorbing effects of sound absorbing material 50. Sound absorbing material 50 may be formed of, for example, flame-resistant inorganic fibers.

Note that in the present embodiment, acoustic transmission tube 30 is disposed proximate to side panel 23, which is the width of cabinet 20, but may be further disposed proximate to side panel 24 facing side panel 23. In this case, since acoustic transmission tube 30 is formed by two opposing surfaces along the width, the occurrence of standing waves can be limited more effectively than when acoustic transmission tube 30 is disposed in only one side.

Note that in the above example, acoustic transmission tube 30 is disposed in cabinet 20, which is a cuboid thinner than it is long and high, but is not limited thereto and may, for example, also be disposed inside a pillar-shaped cabinet that is longer in height than it is wide and deep (the same applies to the following embodiments). In this case, the acoustic transmission tube may be disposed on a top surface plate inside the cabinet or proximate to a bottom surface plate so as to reduce the height of the inside of the cabinet in appearance.

Note that speaker system 100 in Embodiment 1 has been described as an example of a closed-type speaker system, but may also be a bass reflex speaker system in which an acoustic transmission tube is disposed with one open end and one closed end. The acoustic transmission tube used in the bass reflex speaker system includes an aperture in a side wall, similar to acoustic transmission tube 30 in Embodiment 1.

Embodiment 2

A speaker system according to Embodiment 2 will be described.

Figure 7:
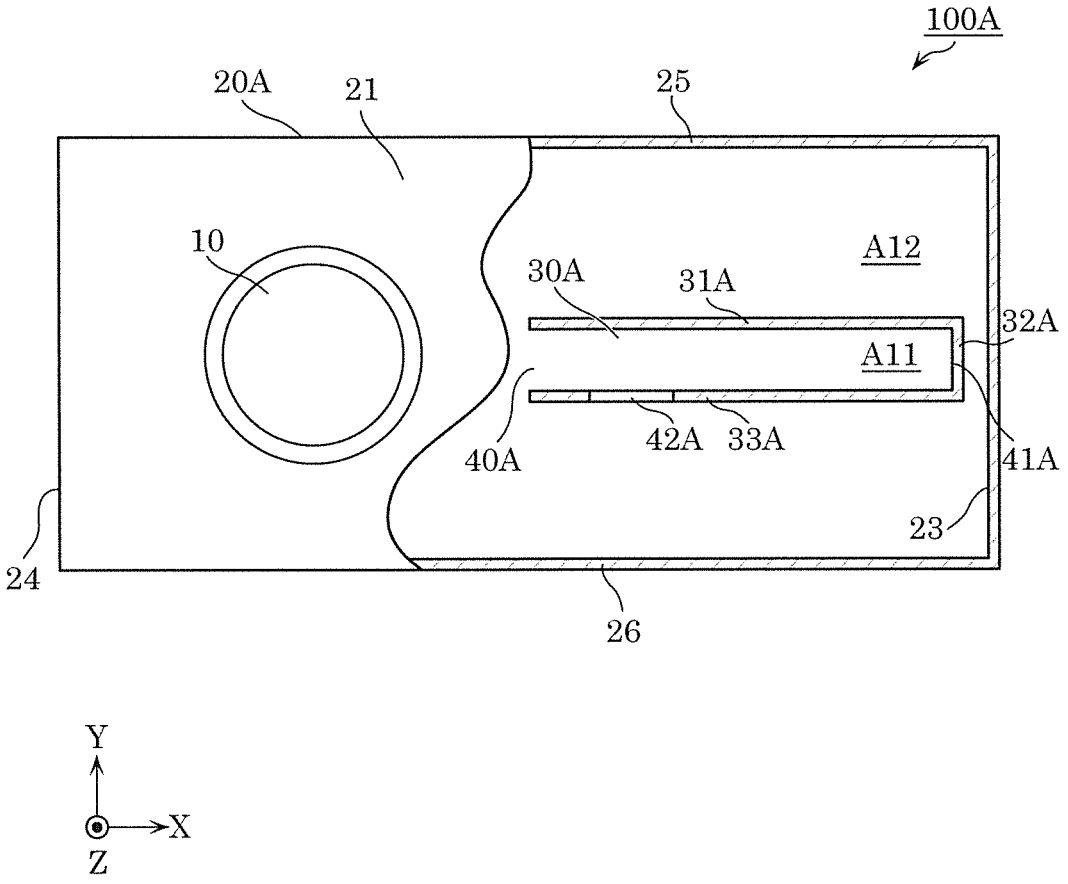
FIG. 7 is a plan view of a speaker system according to Embodiment 2.

FIG. 7 is a plan view of the speaker system according to Embodiment 2.

Speaker system 100A according to Embodiment 2 differs from speaker system 100 according to Embodiment 1 and includes acoustic transmission tube 30A having a straight space.

Speaker system 100A includes speaker unit 10 and a thin cuboid cabinet 20A. Front panel 21, rear panel 22, and side panels 23 to 26 that enclose an inner space of cabinet 20A are similar to those included in cabinet 20 in Embodiment 1, and description thereof is thus omitted. Comparing cabinet 20A to cabinet 20 in Embodiment 1, a configuration of partition plates 31A to 33A is different.

Partition plates 31A to 33A are coupled to front panel 21 and rear panel 22 of cabinet 20A. Partition plates 31A and 33A are disposed substantially parallel with side panels 25 and 26. Partition plates 31A and 33A may also be disposed distanced from side panel 23. Partition plate 31A and partition plate 33A are disposed at a predetermined distance from each other, and face each other in the orientation of the Y-axis. Partition plate 32A is disposed substantially parallel with side panel 23, and one end of partition plate 32A is coupled to an end portion of partition plate 31A and another end of partition plate 32A is coupled to an end portion of partition plate 33A on the positive side of the X-axis. There is no partition plate coupled to ends of partition plates 31A and 33A on the negative side of the X-axis.

In this manner, acoustic transmission tube 30A is formed inside cabinet 20A due to partition plates 31A to 33A dividing an inside of cabinet 20A. Acoustic transmission tube 30A is separated into an inner space A11 of acoustic transmission tube 30A, and space A12, which is a space excluding space A11, by partition plates 31A to 33A in the space between front panel 21 and rear panel 22. Acoustic transmission tube 30A has one straight tubular space that is has one open end (aperture 40A) and one closed end (end edge 41A).

Partition plate 33A has aperture 42A. Aperture 42A is a slit along the direction in which acoustic transmission tube 30A extends (X-axis), similar to aperture 42 described in Embodiment 1.

Even in speaker system 100A with such a configuration is it possible to reduce resonance in acoustic transmission tube 30A since partition plate 33A, which is the side wall of acoustic transmission tube 30A, has aperture 42A. Accordingly, speaker system 100A in Embodiment 2 produces similar results to speaker system 100 in Embodiment 1.

Embodiment 3

A speaker system according to Embodiment 3 will be described.

Figure 8:
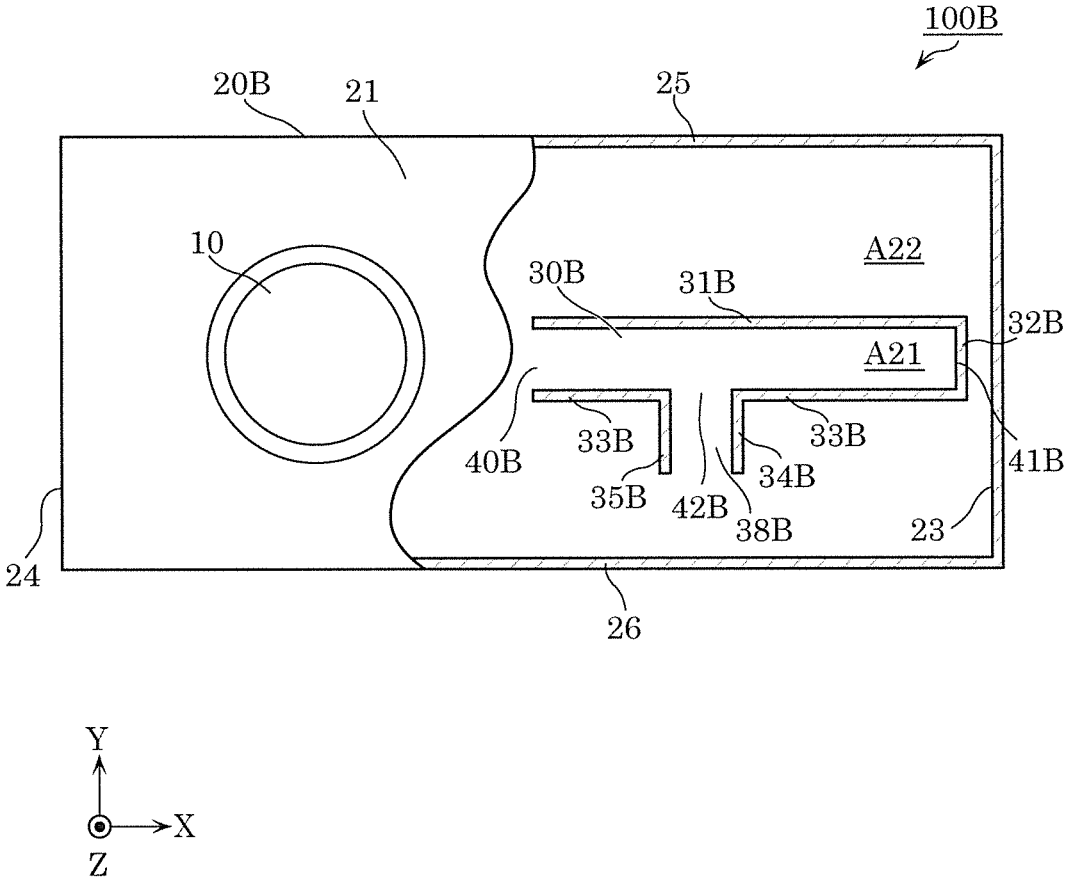
FIG. 8 is a plan view of a speaker system according to Embodiment 3.

FIG. 8 is a plan view of the speaker system according to Embodiment 3.

Speaker system 100B according to Embodiment 3 differs in that acoustic transmission tube 30B includes branch 38B connected to aperture 42B when compared to speaker system 100A according to Embodiment 2.

Speaker system 100B includes speaker unit 10 and the thin cuboid cabinet 20B. Front panel 21, rear panel 22, and side panels 23 to 26 that enclose an inner space of cabinet 20B are similar to those included in cabinet 20A in Embodiment 2, and description thereof is thus omitted. Comparing cabinet 20B to cabinet 20A in Embodiment 2, a configuration of partition plates 31B to 35B is different.

Partition plates 31B to 35B are coupled to front panel 21 and rear panel 22 of cabinet 20B. Partition plates 31B and 33B are disposed substantially parallel with side panels 25 and 26. Partition plates 31B and 33B may also be disposed distanced from side panel 23. Partition plate 31B and partition plate 33B are disposed at the predetermined distance from each other, and face each other in the orientation of the Y-axis. Partition plate 32B is disposed substantially parallel with side panel 23, and one end of partition plate 32B is coupled to an end portion of partition plate 31B and another end of partition plate 32B is coupled to an end portion of partition plate 33B on the positive side of the X-axis. There is no partition plate coupled to ends of partition plates 31B and 33B on the negative side of the X-axis.

Partition plate 33B has aperture 42B. Partition plates 34B and 35B are coupled to aperture 42B in partition plate 33B. Partition plates 34B and 35B are disposed substantially parallel with side panel 23. In other words, partition plates 34B and 35B are disposed in an orientation that intersects with partition plate 33B In this manner, acoustic transmission tube 30B having an elongated inner space A21 along the X-axis similar to acoustic transmission tube 30A according to Embodiment 2, is formed by partition plates 31B to 35B dividing an inside of cabinet 20B. Acoustic transmission tube 30B also includes branch 38B that is formed by a periphery of aperture 42B being separated by partition plates 34B and 35B. Acoustic transmission tube 30B is separated into the inner space A21 of acoustic transmission tube 30B, and space A22, which is a space excluding space A21, by partition plates 31B to 35B in the space between front panel 21 and rear panel 22. Acoustic transmission tube 30B has one straight tubular space and a space surrounded by branch 38B, the tubular space having an open end (aperture 40B) and a closed end (end edge 41B), and further having aperture 42B that communicates with branch 38B.

Even in speaker system 100B with such a configuration is it possible to reduce resonance in acoustic transmission tube 30B since partition plate 33B, which is the side wall of acoustic transmission tube 30B, has aperture 42B. Accordingly, speaker system 100B in Embodiment 3 produces similar results to speaker system 100A in Embodiment 2.

Other Embodiments

Figure 9:
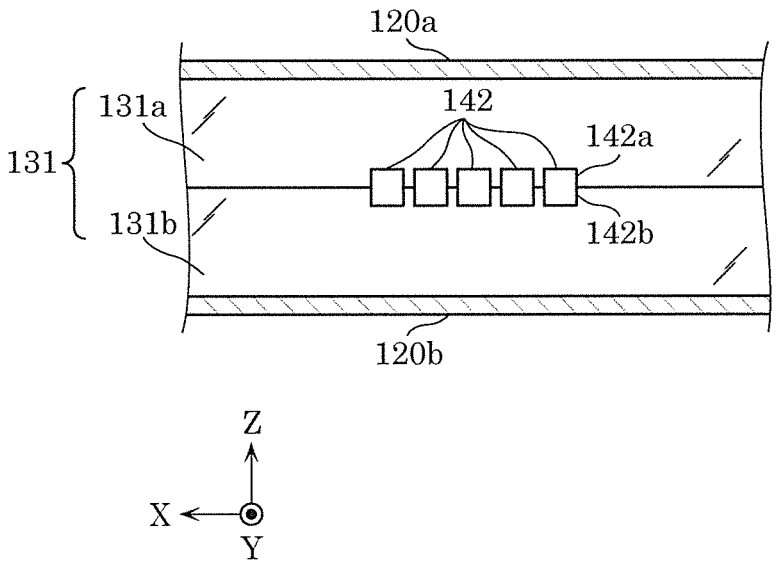
FIG. 9 is an enlarged view of another example of apertures in a side wall of an acoustic transmission tube.

In the above Embodiments 1 and 2, aperture 42 and 42A are slits, but are not limited thereto. For example, as illustrated in FIG. 9, instead of aperture 42 in the above Embodiments 1 and 2, apertures 142 made up of a plurality of holes arranged along the direction in which acoustic transmission tube 30 extends, i.e., the length of cabinet 20, may also be disposed. In this case, partition plate 131 is formed by front partition portion 131*a* included in first cabinet portion 120*a*, and rear partition portion 131*b* included in second cabinet portion 120*b*. Apertures 142 are formed by front cut-out portions 142*a* in front partition portion 131*a* and rear cut-out portions 142*b* in rear partition portion 131*b*. Front cut-out portions 142*a* and rear cut-out portions 142*b* face each other in the orientation of the Z-axis, and form apertures 142 by being joined together. Note that apertures 142 are formed by front partition portions 131*a* and rear partition portions 131*b* each having a cut-out, but is not limited thereto, and any one of front partition portions 131*a* and rear partition portions 131*b* may also have the cut-out or slit-shaped through-holes.

Figure 10:
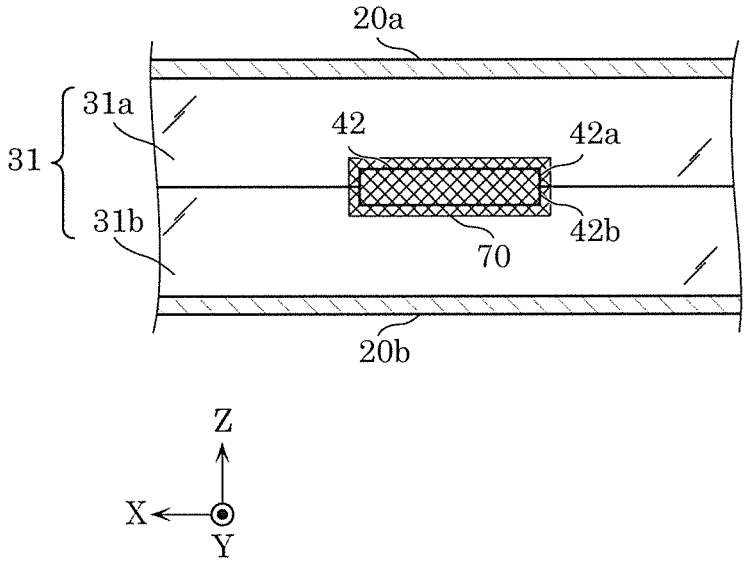
FIG. 10 is an enlarged view of another example of the aperture in the side wall of the acoustic transmission tube.

In speaker systems 100, 100A, and 100B according to the above Embodiments 1 to 3, a damping cloth for covering apertures 42, 42A, and 42B may also be disposed over apertures 42, 42A, and 42B. For example, as illustrated in FIG. 10, damping cloth 70 for covering aperture 42 may be disposed in speaker system 100. Damping cloth 70 is, for example, a meshed cloth that consists of a plurality of horizontally and vertically intersecting fibers. Damping cloth 70 may be formed of, for example, flame-resistant, inorganic fibers.

In speaker systems 100, 100A, 100B according to the above Embodiments 1 to 3, partition plates 31 to 37, 31A to 33A, and 31B to 35B, which form acoustic transmission tubes 30, 30A, and 30B, are disposed substantially parallel with side panels 25 and 26 or side panel 23, but are not limited thereto, and may also be disposed with a slanted orientation with respect to side panels 25 and 26 or side panel 23. In other words, the speaker system may include an acoustic transmission tube with a configuration in which the acoustic transmission tube is disposed inside the cabinet, has an open end and a closed end, and has the aperture in a side wall. In other words, the speaker system with such a configuration produces the improvement of the dip in the sound pressure in the low-tone region of the sound pressure frequency response.

Speaker systems 100, 100A, 100B according to the above Embodiments 1 to 3 may be designed so that resonant frequencies determined by (i) inductance of acoustic impedance in acoustic transmission tubes 30, 30A, and 30B and (ii) acoustic compliance in cabinets 20, 20A, and 20B substantially coincide with peak frequencies of the sound pressure of speaker unit 10 attached to cabinets 20, 20A, and 20B. The peak frequencies at this time are higher than the lowest resonant frequencies of speaker unit 10 while having been attached to cabinets 20, 20A, and 20B. In other words, the peak frequencies may roughly coincide with lowest resonant frequencies $f_{0B}$ when speaker unit 10 is attached to cabinets 20, 20A, and 20B.

Note that the inductance of the acoustic impedance in acoustic transmission tubes 30, 30A, and 30B changes depending on the length (or cross-section area) thereof. More specifically, the longer acoustic transmission tubes 30, 30A, and 30B are, the greater the inductance is. Moreover, the acoustic compliance in cabinets 20, 20A, and 20B changes depending on the volume thereof. More specifically, the larger the volume of cabinet 20, 20A, and 20B, the greater the acoustic compliance therein.

When the inductance of the acoustic impedance in acoustic transmission tubes 30, 30A, and 30B is defined as M, and the acoustic compliance in cabinets 20, 20A, and 20B is defined as C, then resonance frequency $f_0$ can be obtained with Expression 1 below. In other words, resonance frequency $f_0$ can be set at preferred value by adjusting the length (or cross-section area) of acoustic transmission tubes 30, 30A, and 30B, and the volume of cabinets 20, 20A, and 20B.

[Math. 1]

$$f_0 = \frac{1}{2\pi}\sqrt{\frac{1}{MC}} \qquad \text{Expression 1}$$

In speaker systems 100, 100A, and 100B according to the above Embodiments 1 to 3, a ratio of the inner space volume of acoustic transmission tubes 30, 30A, and 30B to the inner space volume of cabinets 20, 20A, and 20B may also be set higher the larger a bandwidth of the sound pressure peak of speaker unit 10 is.

The speaker system according to one or more aspects of the present disclosure has been described above based on the embodiments, but the present disclosure is not limited thereto. Forms obtained by various combinations of the components in the different embodiments that can be conceived by a person skilled in the art which are within the scope of the essence of the present disclosure may also be included in the scope of the one or more aspects of the present disclosure.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure can be extensively applied to, in particular, as a speaker system mounted in audiovisual equipment such as televisions that are becoming smaller and thinner, and audio devices; moving bodies such portable devices, automobiles, trains, and airplanes; and the like.

What is claimed is:

1. A speaker system, comprising:

a speaker unit that outputs sound;

a cabinet having an inner space accommodating the speaker unit and a wall to which the speaker unit is attached; and an acoustic transmission tube that is disposed inside the cabinet, and has an open end and a closed end, wherein an outer surface of the cabinet includes the wall, the speaker unit is attached to the wall so as to output sound toward an outer space that is different from the inner space and is aimed outward from the cabinet, and the acoustic transmission tube has an aperture that is provided in a side wall and communicates with the inner space and a space in the acoustic transmission tube.

2. The speaker system according to claim 1, wherein the aperture is a slit along a direction in which the acoustic transmission tube extends.

3. The speaker system according to claim 1, wherein the aperture comprises a plurality of holes arranged along a direction in which the acoustic transmission tube extends.

4. The speaker system according to claim 1, wherein the acoustic transmission tube has:

a first space;

a second space that is substantially perpendicular to the direction in which the acoustic transmission extends, and communicates with the first space; and a partition plate that is a part of the side wall, and separates the first space and the second space except in a portion in which the first space and the second space communicate with each other, and the aperture is disposed in the partition plate.

5. The speaker system according to claim 1, wherein the acoustic transmission tube further includes a branch that connects to the aperture.

6. The speaker system according to claim 1, further comprising:

a damping cloth that covers the aperture.

7. The speaker system according to claim 1, further comprising:

a sound absorbing material disposed at the closed end of the acoustic transmission tube.

* * * * *